US011534801B2

(12) United States Patent
Volta et al.

(10) Patent No.: US 11,534,801 B2
(45) Date of Patent: Dec. 27, 2022

(54) INSTALLATION FOR SORTING POSTAL PARCELS OR PACKETS

(71) Applicant: SOLYSTIC, Bagneux (FR)

(72) Inventors: Bruno Volta, Gif sur Yvette (FR); Luc Chirol, Paris (FR)

(73) Assignee: SOLYSTIC, Bagneux (FR)

( * ) Notice: Subject to any disclaimer, the term of this patent is extended or adjusted under 35 U.S.C. 154(b) by 123 days.

(21) Appl. No.: 16/944,423

(22) Filed: Jul. 31, 2020

(65) Prior Publication Data

US 2021/0094073 A1 Apr. 1, 2021

(30) Foreign Application Priority Data

Sep. 30, 2019 (FR) ..... 1910788

(51) Int. Cl.

| | |
|---|---|
| ***B07C 3/06*** | (2006.01) |
| ***B07C 3/08*** | (2006.01) |
| ***B66F 9/06*** | (2006.01) |
| ***B66F 9/12*** | (2006.01) |

(52) U.S. Cl.

CPC ..... *B07C 3/06* (2013.01); *B07C 3/082* (2013.01); *B66F 9/063* (2013.01); *B66F 9/12* (2013.01)

(58) Field of Classification Search

CPC .. B07C 3/06; B07C 3/082; B07C 3/08; B07C 3/008; B07C 3/00; B07C 3/02; B66F 9/063

USPC ..... 209/707, 552

See application file for complete search history.

(56) References Cited

U.S. PATENT DOCUMENTS

| | | | | |
|---|---|---|---|---|
| 6,829,369 | B2 * | 12/2004 | Poulin | B07C 3/00 382/101 |
| 2008/0000817 | A1 | 1/2008 | Kostyniuk et al. | |
| 2015/0217334 | A1 * | 8/2015 | Kim | B07C 3/08 209/552 |
| 2017/0320101 | A1 * | 11/2017 | Bombaugh | B07C 3/005 |
| 2017/0361356 | A1 * | 12/2017 | Aschpurwis | B65G 47/46 |

(Continued)

FOREIGN PATENT DOCUMENTS

| | | | | |
|---|---|---|---|---|
| CN | 109420620 | A * | 3/2019 | B07C 3/008 |
| DE | 102015200618 | A1 | 7/2016 | |
| WO | WO-2017202242 | A1 * | 11/2017 | |

OTHER PUBLICATIONS

French Search Report dated May 15, 2020 issued by INPI from corresponding Application No. FR 1910788, 1 page.

*Primary Examiner* — Gene O Crawford
*Assistant Examiner* — Muhammad Awais
(74) *Attorney, Agent, or Firm* — Ware, Fressola, Maguire & Barber LLP

(57) ABSTRACT

An installation for sorting postal parcels or packets, has a carousel sorting conveyor having transport bins that are moved around a closed loop over a plurality of sorting outlets formed by respective storage receptacles, a feed magazine in which bulk stored parcels are put into series and then injected into the transport bins of the conveyor while it is moving, and a monitoring and control unit that acts on the bins of the sorting conveyor so as to open each of them over a receptacle that corresponds to a delivery address of the article following a sorting plan, includes a first sorting pass to sort parcels into first receptacles that are of high bulk storage capacity, and a subsequent sorting pass where the parcels are sorted into second receptacles that are smaller than the first receptacles.

9 Claims, 2 Drawing Sheets

(56) References Cited

U.S. PATENT DOCUMENTS

2018/0264521 A1* 9/2018 Chapelet ..... B07C 3/065
2019/0105687 A1* 4/2019 Bombaugh ..... B07C 3/14

* cited by examiner

INSTALLATION FOR SORTING POSTAL PARCELS OR PACKETS

CROSS-REFERENCE TO RELATED APPLICATION

This application claims priority under 35 USC § 119 to French Patent Application No. 1910788 filed on Sep. 30, 2019, which is hereby incorporated by reference in its entirety.

TECHNICAL FIELD

The present invention relates to an installation for sorting articles such as small postal parcels or packets, which installation comprises a carousel sorting conveyor having transport bins that are moved around a closed loop over a plurality of sorting outlets formed by respective storage receptacles, a feed magazine in which bulk stored parcels are put into series and then injected one-by-one into the transport bins of the conveyor while it is moving, and a monitoring and control unit that acts on the bins of the sorting conveyor so as to open each of them over a receptacle that corresponds to a delivery address of the article following a sorting plan stored in a memory in the monitoring and control unit.

This type of installation is known, in particular, from Patent Documents DE-A-102015200618 and US-A-2008/0000817. The present invention relates more particularly to an installation for sorting in a plurality of sorting passes, and more particularly in two sorting passes into a large number of directions or destinations.

The large number of directions or destinations is of the order of several thousand.

Such directions or destinations correspond to the various delivery rounds for delivering the postal parcels or packets for a country or for a region in a country.

PRIOR ART

Parcel sorting can currently take place in a manner such as to be distributed over a plurality of sorting centers, e.g. over a main center at which parcels arrive in a country and at which outward sorting is performed, and delivery centers in various regions of the country and at which inward sorting is performed.

The problem with current parcel sorting installations is that the parcels are not really sorted by delivery round and that the parcel sorting must then be honed manually.

SUMMARY OF THE INVENTION

An object of the invention is to propose an installation for sorting postal parcels or packets such as "small international parcels" (or "petits paquets internationaux" or "PPI" as they are known in France) that makes it possible to perform outward and inward sorting in a manner such that it is centralized on a single site so as to facilitate efficiency, automation, and ease of delivery of the parcels or packets over a large number of directions.

Another object of the invention is to propose an installation for multi-pass sorting of postal parcels or packets that has a small footprint for a large number of sorting outlets.

To this end, the invention provides an installation for sorting articles, which installation comprises a carousel sorting conveyor having article transport bins that are moved around a closed loop over a plurality of sorting outlets formed by respective storage receptacles, an article feed magazine in which bulk stored articles are put into series and then injected one-by-one into the transport bins of the conveyor while it is moving, and a monitoring and control unit that acts on the bins of the sorting conveyor so as to open each of them over a receptacle that corresponds to a delivery address of the article following a sorting plan stored in a memory in the monitoring and control unit, said installation being characterized in that the monitoring and control unit is arranged to run the sorting into the receptacles of the sorting outlets in a plurality of passes, in that, during a first sorting pass, the parcels are sorted into first receptacles that are of high bulk storage capacity, and in that, during a subsequent sorting pass, the parcels are sorted into second sorting outlet receptacles that are of smaller bulk storage capacity than the first receptacles.

This installation may further have the following features:

- the first receptacles are containers and the second receptacles are trays or bags;
- the first and second receptacles are wheeled receptacles;
- a plurality of wheeled receptacles disposed in line serve the same sorting outlet, the line of receptacles being moved under the sorting outlet as the receptacles are filled with articles;
- the installation further comprises shuttle robots caused to move by the monitoring and control unit to dock with said wheeled receptacles and to drive them to move under the sorting outlets;
- the monitoring and control unit is arranged to cause the shuttle robots to move in such a manner as to bring the first receptacles filled with articles from the sorting outlets to the feed magazine;
- each of the bins of the sorting conveyor is in the form of a rectangular platform equipped with a rim that is retractable on one side, and the articles are injected sideways onto the platforms that are placed in a tilted position during the injection; and
- at the outlet via which the articles as put in series exit, the feed magazine has a conveyor for conveying articles flat, which conveyor extends between two opposite segments of the loop.

The articles are postal parcels or packets such as small international parcels.

The invention is described below in more detail and is illustrated by the drawings that show an example of an installation for sorting postal parcels or packets.

DETAILED DESCRIPTION OF THE INVENTION

Figure 1:
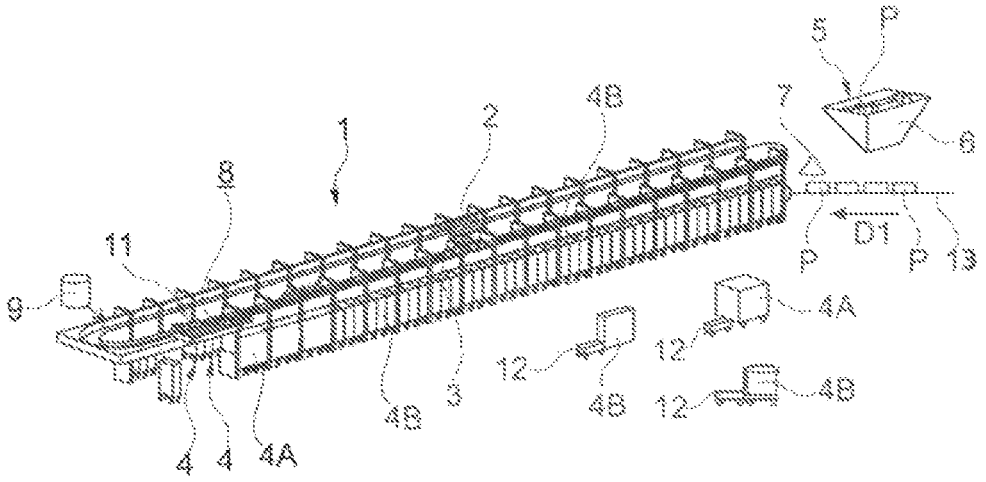
FIG. 1 is a diagrammatic view of a sorting installation of the invention.

FIG. 1 is a diagrammatic view showing a sorting installation 1 of the invention, in this example for sorting small international parcels, each of which is generally rectangular block shaped and has a weight of less than 3 kg.

Figure 2:
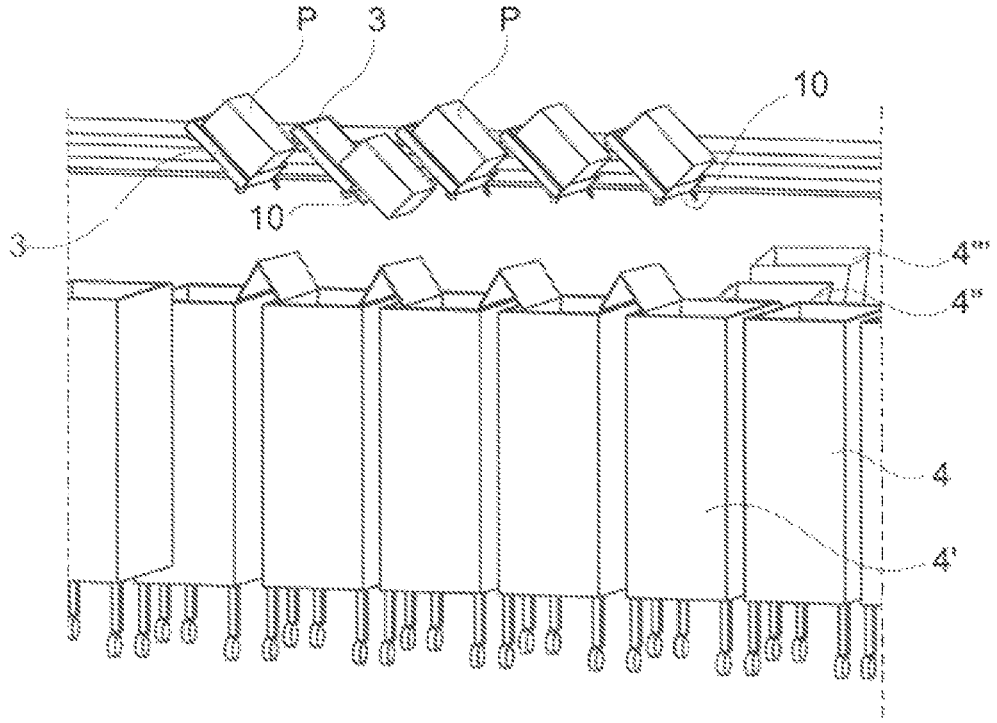
FIG. 2 shows bins in the form of platforms for conveying articles, and sorting outlet receptacles.

The sorting installation 1 includes a carousel sorting conveyor 2 having transport bins 3, which, in this example, are in the form of rectangular platforms or trays, each of which has a rim or a flap that is retractable on one side, as can be seen in FIG. 2.

While tilted, said transport bins 3 are moved around a closed loop over a plurality of sorting outlets formed by storage receptacles 4 that are open at their tops and that, in this example, are disposed under two parallel and opposite runs of the loop.

The sorting installation 1 further includes a parcel feed magazine 5 having a hopper 6 into which the parcels P to be sorted are stored in bulk.

On exiting from the hopper, the parcels are put into series, for example, at constant pitch with a view to being injected onto the platforms of the sorting conveyor.

FIG. 1 is a highly diagrammatic view of a device 7 for taking digital images, which device forms an image of each parcel put in series in the magazine 5 and, on the basis of said image, automatically recognizes a distribution or delivery address of the parcel by using Optical Character Recognition (OCR).

The parcels as put in series are conveyed from the feed magazine 5 to an injection device 8 at which the parcels are injected one-by-one into empty transport bins of the sorting conveyor (the bins in this example thus being tilted platforms having retractable flaps).

On the basis of the address data recognized by the device 7, a monitoring and control unit 9 of the installation shown in FIG. 1 acts on the transport bins of the sorting conveyor that contain parcels so as to open each of those bins (in this example by opening the flap 10 of the platform as shown in FIG. 2) over a receptacle 4 that corresponds to the delivery address of the parcel in a sorting plan stored in a memory in the monitoring and control unit.

When the bin opens, i.e. when the flap 10 of the platform opens, the parcel falls by gravity into the corresponding receptacle situated just below it.

Figure 3:
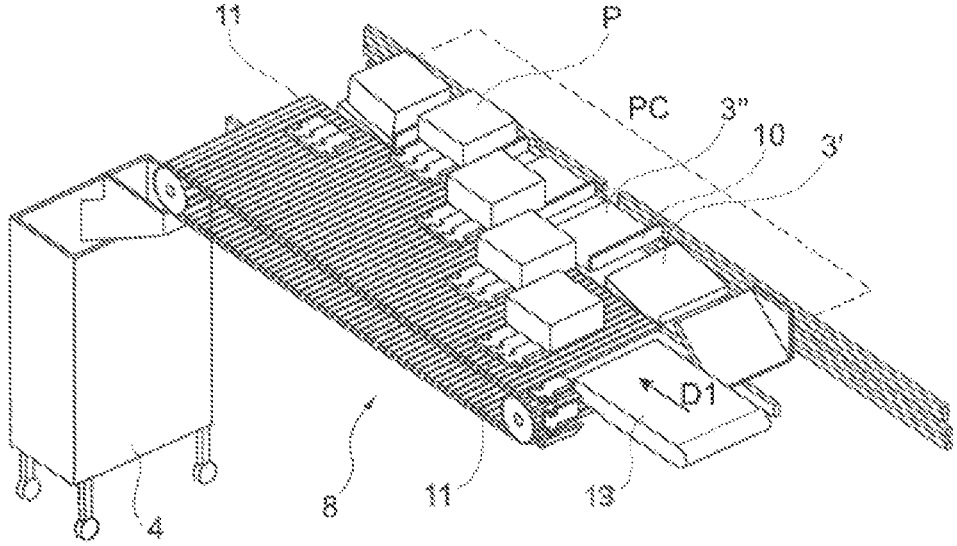
FIG. 3 shows an injector for injecting articles into the transport bins of the sorting conveyor.

The parcels are conveyed in series from the magazine 5 to the injection device 8, in this example by a conveyor 13 for conveying articles flat, such as a belt conveyor or a roller conveyor, as shown in FIGS. 1 and 3.

In the example shown in FIG. 1, the conveyor 13 passes under the loop of the sorting conveyor and extends longitudinally between the two opposite parallel runs of the loop of the sorting conveyor, thereby contributing to the compactness of the sorting installation of the invention.

In this example, the parcels are injected onto the platforms of the sorting conveyor from the inside of the loop of the sorting conveyor, in this example via piston pushers 11 that are shown in FIG. 3.

As can be seen in FIG. 3, the rectangular platforms 3 that travel around a loop over the sorting outlets while being tilted (platform indicated by reference 3' in FIG. 3), are brought into the horizontal position (like platform 3" shown in FIG. 3) at the time a parcel is injected onto the platform and the injection thus takes place by the parcel sliding perpendicularly to the sorting conveyor.

FIG. 3 also shows a receptacle 4 at the end of the injection device, which receptacle serves to recover the parcels P that it has not been possible to inject onto the platforms of the sorting conveyor.

In accordance with the invention, the sorting plan that is run by the monitoring and control unit 9 in the sorting installation 1 is a multi-pass sorting plan and, in this example, in particular, a sorting plan in two passes.

In this sorting plan, during the first sorting pass, the parcels P as put in series in the magazine are firstly sorted into first receptacles having high bulk storage capacity, i.e., for example, the capacity to store several hundreds of small international parcels bulk.

In this first sorting pass, the parcels P are separated, e.g. into batches of delivery rounds or "postman's walks".

A receptacle having high bulk storage capacity is indicated in FIG. 1 by reference 4A.

A receptacle 4A may, for example, be a container.

At the end of the first sorting pass, the containers filled with parcels sorted in the first pass are moved by shuttle robots 12 to the feed inlet of the installation for being put back into the hopper 5.

Said shuttle robots are controlled by the monitoring and control unit 9 to move, in particular, from a zone in which the shuttle robots are stowed to the sorting outlets of the installation, or indeed from the sorting outlets to the feed magazine of the installation or else to a zone in which empty or full receptacles are stored.

During the second sorting pass, the parcels P are sorted into second sorting outlet receptacles that are of bulk storage capacity that is smaller than the bulk storage capacity of the receptacles 4A, e.g. a capacity of a few tens of small international parcels.

In this second sorting pass, the parcels P are separated, e.g. by delivery round.

A receptacle having low bulk storage capacity is indicated in FIG. 1 by reference 4B.

A receptacle 4A may, for example, be a tray or a bag.

The receptacles 4A and 4B are wheeled receptacles or receptacles mounted on wheeled trolleys. The bags are carried by wheeled trolleys in the form of frames from which the bags are hung, the top of the bag being kept open at the top of the frame.

After the second sorting pass, the receptacles 4B as filled with parcels can be grouped together by destination and by time slot for being transported by means of the shuttle robots towards a distribution or delivery depot.

The first sorting pass into receptacles of high bulk storage capacity makes it possible to simplify storage and re-feeding the installation, while the second sorting pass into receptacles of lower bulk storage capacity makes it possible to adapt the second receptacles to the volume of a delivery round, for example, and the smaller-capacity receptacles may be grouped together in larger containers for being transported by truck.

The monitoring and control unit 9 is thus parameterized to cause the transport bins 3 to be poured out at successive places that correspond to the dimensions of the successive receptacles along the sorting conveyor, and, at the same time, to cause the shuttle robots 12 to move so that they put the appropriate receptacles under the appropriate sorting outlets.

In this installation 1 and as shown in FIG. 1, it is optionally possible, in the sorting plan, to assign first sorting outlets to first receptacles 4A and second sorting outlets to second receptacles 4B with the first outlets being different from the second outlets in such a manner as to start the second sorting pass before the end of the first sorting pass, and thereby accelerate the sorting process.

In accordance with the invention, the parcel sorting process may include a plurality of successive sorting passes into receptacles 4A and a plurality of sorting passes into receptacles 4B.

In the installation 1 of the invention, a plurality of wheeled receptacles (of the type 4A or 4B) indicated by references 4', 4" 4'" may be disposed in line to serve the same sorting outlet as shown in FIG. 2, and a system may be provided for moving the line of receptacles under the sorting outlet as the receptacles in line are filled.

This makes it possible to further increase the sorting capacities of the installation of the invention.

With the sorting installation of the invention, it is possible to design mixed sorting outlets that are suitable for receiving both the large and the small receptacles 4A and 4B. The number of sorting outlets in the installation depends on the length of the loop of the sorting conveyor and on the size of the receptacles placed under the loop of the sorting conveyor.

Naturally, the monitoring and control unit 9 stores in a memory the topography of the sorting outlets so as to make it possible to perform the sorting into the sorting outlet receptacles.

The batches of delivery rounds sorted in the first pass are, for example, constituted with full shipments, i.e. groups of delivery rounds that are to be grouped together in the same transport containers.

If it is considered that the installation can separate n batches in the first sorting pass and that each batch is separated into m delivery rounds, the total number of delivery rounds that can be separated is given by the expression n×m.

An installation of the invention having 64 mixed sorting outlets makes it possible to separate about 4000 delivery rounds.

It should be noted that this sorting installation of the invention can handle sorting parcels and packets with, in addition, large-format flat postal articles or "flats".

This sorting installation is very well adapted to replace a conventional sorting installation already installed in a postal sorting center, for example.

The architecture of the sorting installation of the invention makes it possible to achieve high throughput rates of the order of 10,000 parcels or packets per hour.

What is claimed is:

1. An installation for sorting articles, comprising:

a carousel sorting conveyor having article transport bins that are moved around a closed loop over a plurality of sorting outlets formed by respective storage receptacles, an article feed magazine in which bulk stored articles are put into series and then injected one-by-one into the transport bins of the conveyor while it is moving, and a monitoring and control unit that acts on the bins of the sorting conveyor so as to open each of them over a receptacle that corresponds to a delivery address of the article following a sorting plan stored in a memory in the monitoring and control unit, wherein the monitoring and control unit is configured to run the sorting into the receptacles of the sorting outlets in a plurality of passes, in that, during a first sorting pass, the parcels are sorted into first receptacles that are of high bulk storage capacity, and in that, during a subsequent sorting pass, the parcels are sorted into second sorting outlet receptacles that are of smaller bulk storage capacity than the first receptacles, wherein the first and second receptacles are wheeled receptacles.

2. The installation according to claim 1, wherein the first receptacles are containers and the second receptacles are trays or bags.

3. The installation according to claim 2, wherein the first and second receptacles are wheeled receptacles.

4. The installation according to claim 1, wherein a plurality of wheeled receptacles disposed in line serve the same sorting outlet, the line of receptacles being moved under the sorting outlet as the receptacles are filled with articles.

5. The installation according to claim 1, wherein the installation further comprises shuttle robots caused to move by the monitoring and control unit to dock with said wheeled receptacles and to drive them to move under the sorting outlets.

6. The installation according to claim 5, wherein the monitoring and control unit is configured to cause the shuttle robots to move in such a manner as to bring the first receptacles filled with articles from the sorting outlets to the feed magazine.

7. An installation for sorting articles, comprising:

a carousel sorting conveyor having article transport bins that are moved around a closed loop over a plurality of sorting outlets formed by respective storage receptacles, an article feed magazine in which bulk stored articles are put into series and then injected one-by-one into the transport bins of the conveyor while it is moving, and a monitoring and control unit that acts on the bins of the sorting conveyor so as to open each of them over a receptacle that corresponds to a delivery address of the article following a sorting plan stored in a memory in the monitoring and control unit, wherein the monitoring and control unit is configured to run the sorting into the receptacles of the sorting outlets in a plurality of passes, in that, during a first sorting pass, the parcels are sorted into first receptacles that are of high bulk storage capacity, and in that, during a subsequent sorting pass, the parcels are sorted into second sorting outlet receptacles that are of smaller bulk storage capacity than the first receptacles, wherein the first and second receptacles are wheeled receptacles, wherein each of the bins of the sorting conveyor is in the form of a rectangular platform equipped with a rim that is retractable on one side, and in that the articles are injected sideways onto the platforms that are placed in a tilted position during the injection.

8. The installation according to claim 1, wherein at the outlet via which the articles as put in series exit, the feed magazine has a conveyor for conveying articles flat, which conveyor extends between two opposite segments of the loop.

9. The installation according to claim 1, wherein the articles are postal parcels or packets.

* * * * *